US012115578B2

(12) United States Patent
Carosielli et al.

(10) Patent No.: US 12,115,578 B2
(45) Date of Patent: Oct. 15, 2024

(54) ROBOTIZED SYSTEM FOR CHANGING A SLIDING GATE VALVE PLATE

(71) Applicant: Vesuvius Group, S.A., Ghlin (BE)

(72) Inventors: David Carosielli, Chapelle-Lez-Herlaimont (BE); Arnaud Lamblotte, Haine-Saint-Pierre (BE)

(73) Assignee: Vesuvius Group, S.A., Ghlin (BE)

( * ) Notice: Subject to any disclaimer, the term of this patent is extended or adjusted under 35 U.S.C. 154(b) by 615 days.

(21) Appl. No.: 17/413,850

(22) PCT Filed: Dec. 17, 2019

(86) PCT No.: PCT/EP2019/085618
§ 371 (c)(1),
(2) Date: Jun. 14, 2021

(87) PCT Pub. No.: WO2020/127241
PCT Pub. Date: Jun. 25, 2020

(65) Prior Publication Data

US 2022/0040757 A1 Feb. 10, 2022

(30) Foreign Application Priority Data

Dec. 18, 2018 (EP) ..... 18213329

(51) Int. Cl.
*B22D 41/38* (2006.01)
*B22D 41/24* (2006.01)
*B22D 41/56* (2006.01)

(52) U.S. Cl.
CPC ..... *B22D 41/38* (2013.01); *B22D 41/24* (2013.01); *B22D 41/56* (2013.01)

(58) Field of Classification Search
CPC ..... B22D 41/24; B22D 41/38; B22D 41/56; B22D 41/13; B25J 11/005; B25J 9/06
(Continued)

(56) References Cited

U.S. PATENT DOCUMENTS 311,902 A 2/1885 Lewis
506,328 A 10/1893 Morris
(Continued)

FOREIGN PATENT DOCUMENTS

CN 2002120051 A 4/2002
CN 101553334 A 10/2009
(Continued)

OTHER PUBLICATIONS

Office Action issued in corresponding Japanese Patent Appln. No. 2021-535187, dated Dec. 5, 2023.
(Continued)

*Primary Examiner* — Jessee R Roe
*Assistant Examiner* — Michael Aboagye
(74) *Attorney, Agent, or Firm* — MaxGoLaw PLLC

(57) ABSTRACT

A robotized system for fixing a sliding gate valve plate to a sliding gate valve or removing a sliding gate valve plate from a sliding gate valve comprises a sliding gate valve plate, a metallurgic vessel provided with a sliding gate valve comprising a plate support frame comprising a receiving cradle suitable for receiving and locking the sliding gate valve plate, and a robot comprising a handling interface provided with gripping clamps for gripping the sliding gate valve plate. The sliding gate valve plate comprises gripping holds mating the gripping clamps of the robot, such that the robot can securely hold and handle the sliding gate valve plate.

13 Claims, 8 Drawing Sheets

(58) Field of Classification Search
USPC ..... 222/590, 591, 594, 596, 597, 600; 266/236
See application file for complete search history.

(56) References Cited

U.S. PATENT DOCUMENTS

| | | | | |
|---|---|---|---|---|
| 4,685,850 | A | 8/1987 | Ohta et al. | |
| 5,645,793 | A * | 7/1997 | Yamamoto | B22D 41/22 222/600 |
| 5,665,264 | A * | 9/1997 | Sato | B22D 41/56 222/607 |
| 8,042,601 | B2 * | 10/2011 | Bowman | B22D 11/0622 164/428 |
| 8,215,375 | B2 * | 7/2012 | Ebner | B22D 11/111 266/50 |
| 8,376,196 | B2 * | 2/2013 | Ebner | B22D 41/24 266/236 |
| 8,498,740 | B2 * | 7/2013 | Truttmann | B22D 41/22 222/597 |
| 8,498,742 | B2 | 7/2013 | Truttmann | |
| 10,864,642 | B2 | 12/2020 | Miyashita | |
| 11,135,646 | B2 | 10/2021 | Imahase | |
| 2010/0017027 | A1 | 1/2010 | Truttmann | |
| 2017/0045106 | A1 | 2/2017 | Kendrick | |
| 2020/0038944 | A1 | 2/2020 | Imahase | |
| 2022/0040757 | A1 | 2/2022 | Carosielli et al. | |

FOREIGN PATENT DOCUMENTS

| | | | |
|---|---|---|---|
| CN | 101612663 | A | 12/2009 |
| CN | 213002623 | U | 4/2021 |
| DE | 10 2009 050216 | A1 | 12/2010 |
| EP | 2500150 | A2 | 9/2012 |
| EP | 2547474 | A1 | 2/2017 |
| JP | H04 66268 | A1 | 3/1992 |
| JP | H07 60434 | A1 | 3/1995 |
| JP | 07132484 | A | 5/1995 |
| JP | H07124885 | A | 5/1995 |
| JP | H08 19853 | A2 | 1/1996 |
| JP | H0839233 | A | 2/1996 |
| JP | 2018065184 | A | 4/2018 |
| WO | 2008025562 | A1 | 3/2008 |
| WO | WO 2017/129563 | A | 8/2017 |
| WO | 2018066284 | A1 | 4/2018 |
| WO | 2018074424 | A1 | 4/2018 |

OTHER PUBLICATIONS

Office Action issued in corresponding Japanese Patent Appln. No. 2021-535187, dated Jul. 25, 2023.
Notice of Opposition issued in corresponding European Appln. No. 19820778.9, dated May 15, 2024 (with English translation).

* cited by examiner

ROBOTIZED SYSTEM FOR CHANGING A SLIDING GATE VALVE PLATE

CROSS-REFERENCE TO RELATED APPLICATIONS

This application is a U.S. national stage application, filed under 35 U.S.C. § 371, of International Application No. PCT/EP2019/085618, which was filed on Dec. 17, 2019, and which claims priority from European Patent Application No. EP 18213318.1, which was filed on Dec. 18, 2018, the contents of each of which are incorporated by reference into this specification.

BACKGROUND OF THE INVENTION

(1) Field of the Invention

The present invention relates to a robotized system for changing a sliding gate valve plate in a sliding gate valve in a metallurgic casting installation. The present invention proposes a robotized system which can be fully automated, capable of removing a spent sliding gate valve plate from its casting position in a plate support frame coupled to a metallurgic vessel, storing it for refurbishing or for disposal, and taking a new sliding gate valve plate and loading it into its casting position in the plate support frame.

(2) Description of the Related Art

Sliding gate valves have been known since 1883. Sliding gate valves are used to control the flow of molten metal poured from an upstream metallurgic vessel to a downstream vessel. For example, from a furnace to a ladle, from a ladle to a tundish or from a tundish into an ingot mould. For example, US-A-0311902 or US-A-0506328 disclose sliding gate valves arranged at the bottom of a casting ladle wherein pairs of refractory sliding gate valve plates provided with a through bore are slid one with respect to the other. When the pouring orifices are in register or partially overlap, molten metal can flow through the sliding gate valve while when there is no overlap between the pouring orifices, the molten metal flow is totally stopped. Partial overlap of the pouring orifices allows the regulation of the molten metal flow by throttling the molten metal stream. Although sliding gate valves have evolved considerably in the last decades, the principle remains the same, with one plate sliding relative to another to control the level of overlap between the through bores of the two plates.

Sliding gate valve plates are operated under severe conditions when mounted in a sliding gate valve and wear off with time, so that they must be replaced at regular intervals. Tube changing systems for changing a pouring nozzle from a sliding gate valve of a tundish have been proposed in the art, such as e.g., in EP2547474. In many cases, however, the metallurgic vessel is emptied of its content, moved away from the casting installation and checked for signs of excessive wear and refurbished, including changing the sliding gate valve plates. To date, this operation is made mostly manually by human operators. This is hard labour: handling heavy weights under time pressure, at high temperatures and requiring strength to disrupt any adhesion between mortar and a sliding gate valve plate to be changed. Human errors can be made under such stressful conditions. There is a demand from the industry to develop automated systems for changing sliding gate valve plates using robots instead of human operators.

Configuring a robot for changing a sliding gate valve plate, however, faces many challenges. The sliding gate valve plates are quite heavy to handle, and they must be positioned with much accuracy into corresponding receiving cradles provided in the plate support frame. The position of the metallurgic vessel changes from one operation to the other and the robot must adapt to the different positions of each new metallurgic vessel brought for refurbishing. Spent sliding gate valve plates are hot, whilst new sliding gate valve plates are cold, thus changing the dimensions of the plates. Often fumes and vapours obscure visibility. A top sliding gate valve plate is coupled to an inner nozzle with mortar, which must be broken before removing the top sliding gate valve plate. To the applicant's best knowledge, no satisfactory robotized system for changing sliding gate valve plates has been successfully implemented in a metallurgic installation.

US20100017027 describes an arrangement for the maintenance of a sliding gate valve mounted on the spout of a container for molten metal. The arrangement comprises at least one tool magazine, means for opening and closing the sliding gate valve, and a robot comprising an automatic grip changing system, the robot being able to automatically detect the exact position of the container or of the sliding gate valve. This document, however, does not give any details on the automatic grip changing system.

JP H07 60434 discloses an apparatus for replacing the nozzle and plates of metallurgical vessel. In the system described, the plates are handled by their through bores, which can consequently be damaged during the operation.

DE 10 2009 050216 discloses a method and apparatus for exchanging the slide closure of a metallurgical vessel, wherein the sliding closure is gripped by an industrial robot. This document, however, does not give any details on the gripping system.

U.S. Pat. No. 5,645,793 discloses a system for exchanging a whole slide gate valve of a metallurgical vessel but does not disclose a system for replacing individual slide gate valve plates.

JP H08 19853 also discloses a system for exchanging a whole slide gate valve of a metallurgical vessel. Once again, a system for replacing individual slide gate valve plates is not disclosed.

JP H04 66268 also discloses a system for exchanging a whole slide gate valve of a metallurgical vessel. Once again, a system for replacing individual slide gate valve plates is not disclosed.

The aim of the present invention is to meet the foregoing challenges by providing a novel robotized system for changing sliding gate valve plates, combining the efficacy and reproducibility of a robot with the flexibility required to adapt to changing conditions (temperature, dimensions, relative positions, fumes, etc.). This and other advantages of the present invention are explained more in detail in the following sections.

BRIEF SUMMARY OF THE INVENTION

The objectives of the present invention have been reached with a robotized system for fixing or removing a sliding gate valve plate to or from a sliding gate valve, comprising:

(a) a sliding gate valve plate comprising a sliding surface separated from a second surface by a thickness of the sliding gate valve plate and joined to one another by a peripheral edge, and comprising a through bore extending normal to the sliding surface, wherein the sliding gate valve plate is selected among, a top sliding gate valve plate, a bottom sliding gate valve plate, and optionally a mid-sliding gate valve plate wherein the second surface is a second sliding surface, (b) a metallurgic vessel provided with a sliding gate valve comprising a support structure comprising a plate support frame comprising a receiving cradle suitable for receiving and locking the sliding gate valve plate, including, a fixed top plate support frame for receiving and locking the top sliding gate valve plate, a bottom plate support frame (11L) for receiving and locking the bottom sliding gate valve plate, and optionally a mid-plate support frame (11*m*) for receiving and locking the mid-sliding gate valve plate, sandwiched between the top and bottom sliding gate valve plates, Wherein the bottom plate support frame is a movable carriage suitable for sliding the sliding surface of the bottom sliding gate valve plate against and relative to the sliding surface of the top sliding gate valve plate, thus forming a two-plate sliding gate, or optionally, the mid-plate support frame is a movable carriage suitable for sliding the sliding surface and the second sliding surface of the mid-sliding gate valve plate against and relative to the sliding surfaces of the top and bottom sliding gate valve plates, respectively, thus forming a three-plate sliding gate, for bringing into and out of registry the through bores of the top and bottom sliding gate valve plates and optionally the mid-sliding gate valve plate, (c) a robot comprising a handling interface provided with gripping clamps for gripping the sliding gate valve plate, and configured for, collecting a new unit of the sliding gate valve plate and coupling and locking it to the corresponding plate support frame, and/or unlocking and removing a spent unit of the sliding gate valve plate from the corresponding plate support frame, wherein, (d) the gripping clamps can be moved from an open position suitable for surrounding the peripheral edge of the sliding gate valve plate to a gripping position suitable for coupling the gripping clamps to gripping holds located at the peripheral edge and/or at the second surface, adjacent to the peripheral edge, of the sliding gate valve plate, such that the robot can securely hold and handle the sliding gate valve plate, and (e) the receiving cradle of the plate support frame comprises clearings or apertures allowing access of the gripping clamps to the gripping holds when the sliding gate valve plate is locked in the receiving plate support frame.

The sliding gate valve plate can be a top or a bottom sliding gate valve plate, wherein the second surface has an area smaller than the sliding surface. In a projection onto the sliding surface, the second surface is enclosed within the sliding surface, and the peripheral edge and/or the second surface comprises bevelled portions forming the gripping holds.

Alternatively, the gripping holds can be protrusions protruding out of the peripheral edge and are preferably part of a metal can cladding a portion of the peripheral edge. The gripping holds can also be recesses opening at the peripheral edge and penetrating in the thickness of the slide gate plate. The recesses are preferably at least partly formed in a metal can cladding a portion of the peripheral edge. A sliding gate valve plate can comprise a combination of gripping holds formed by bevelled portions, protrusions and/or recesses.

Alternatively, the gripping holds can be portions of the second surface adjacent to the peripheral edge, and the clearings or apertures are then sufficiently deep to allow the gripping clamps to reach a position facing said portions of the second surface when the sliding gate valve plate is locked in the receiving plate support frame, so that the gripping clamps can move to the gripping position, engaging the second surface.

In an advantageous embodiment, the handling interface of the robot comprises N=3 or 4 gripping clamps, which are L-shaped with a free end and a coupled end movably mounted so as to move the free end from the open position to the gripping position suitable for coupling the free end of the L-shaped gripping clamps to the gripping holds of the sliding gate valve plate. The L-shaped gripping clamps can be rotatably mounted so as to rotate between the open and gripping positions about a rotation axis, intersecting the coupled end normal to both free end and coupled end, forming a rocking clamp (25*r*), or coaxial with the coupled end forming a gyrating clamp (25*g*), wherein a number, n, of L-shaped gripping clamps are rotatable about one of the foregoing rotation axes and the remaining (N−n) L-shaped gripping clamps are rotatable about the other of the foregoing rotation axes, with n=1 to 4, preferably N=4 and n=2. The rocking clamps can rotate about a single axis or can rotate about two axes parallel to one another.

For example, the handling interface of the robot comprises one or two adjacent rocking clamps and comprises one or two adjacent gyrating clamps. In an advantageous embodiment, the handling interface or the top plate support frame comprises a protrusion such that when the robot faces the top plate support frame to remove the top sliding gate valve plate therefrom, with the one or two gyrating clamps in gripping position, the robot is at an angle with respect to the sliding surface such that the one or two rocking clamps can rotate and contact the gripping holds, but cannot reach the gripping position without pulling one end of the top sliding gate valve plate which rotates about an axis passing by the one or two gyrating clamps and easily breaking mortar adhering it to the metallurgic vessel.

The handling interface of the robot preferably further comprises resilient elements suitable for pressing against the sliding surface when the free ends of the L-shaped gripping clamps are in the gripping position and thus locking the sliding gate valve plate to the handling interface of the robot.

In an advantageous embodiment, the handling interface of the robot comprises guiding pins protruding beyond a plane comprising the sliding surface when a sliding gate valve plate is gripped. The plate support frame comprises funnel shaped cavities for receiving the guiding pins and guiding the sliding gate valve plate in alignment with the receiving cradle.

The handling interface is preferably coupled to an arm of the robot by means of a coupling element comprising pneumatic or hydraulic system capable of controlling the compliance of the coupling element and thus the compliance of the coupling of the handling interface to the robot.

The present invention also concerns a method for fixing a sliding gate valve plate to a plate support structure of a slide gate valve mounted at a bottom of a metallurgic vessel, comprising, (a) providing a robotized system as defined supra,
(b) driving the handling interface toward a new unit of a slide gate valve plate,
(c) engaging the gripping clamps, advantageously by translation and/or rotation, in the gripping holds of the new unit thus reaching their gripping position, such that the robot securely holds and can handle the new unit,
(d) driving the handling interface with the new unit to the plate support frame, with the gripping clamps engaged in the corresponding clearings or apertures,
(e) disengaging the gripping clamps, advantageously by translation and/or rotation, from the gripping holds,
(f) driving the handling interface away from the plate support frame.

The present invention also concerns a method for removing a top sliding gate valve plate from a plate support structure of a slide gate valve mounted at a bottom of a metallurgic vessel, comprising, (a) providing a robotized system as defined supra wherein the handling interface or the top plate support frame comprises a protrusion, and wherein a top sliding gate valve plate is loaded in a top plate support frame and coupled to an inner nozzle with mortar.
(b) engaging the gyrating clamps entirely into the corresponding clearings and rotating the gyrating clamps to engage into the corresponding gripping holds thus reaching their gripping position,
(c) engaging the rocking clamps into the corresponding clearings as far as the protrusion allows, and rotating the rocking clamps towards their gripping position to partially engage the rocking clamps into the corresponding gripping holds, thereby pulling one end of the top sliding gate valve plate away from the inner nozzle, and initiating a crack in the mortar until the rocking clamps are entirely engaged into the corresponding gripping holds, and reach their gripping position,
(d) removing the top sliding gate valve plate from the top plate support frame by driving the handling interface away from the top plate support frame.

BRIEF DESCRIPTION OF THE SEVERAL VIEWS OF THE DRAWINGS

In these figures.

DETAILED DESCRIPTION OF THE INVENTION

Figure 1A:
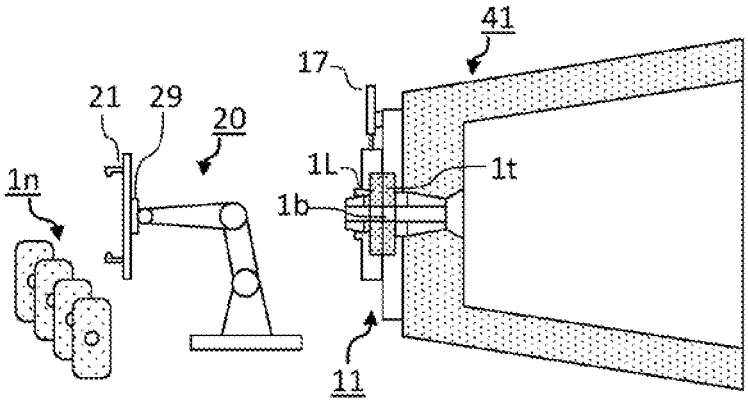
FIG. 1 depicts various steps for changing sliding gate valve plates in a metallurgic vessel with a robot according to the present invention.
Figure 1B:
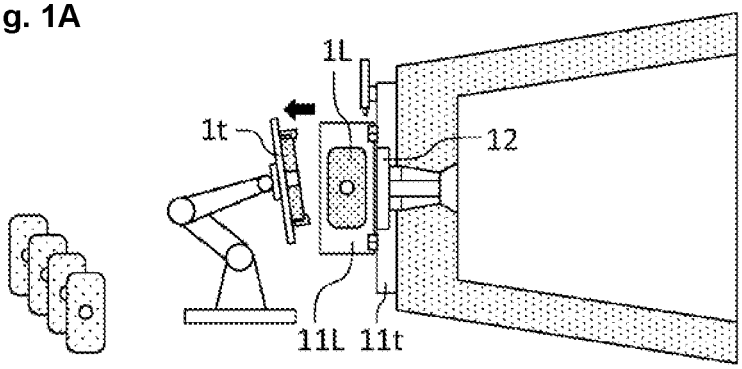
Figure 1C:
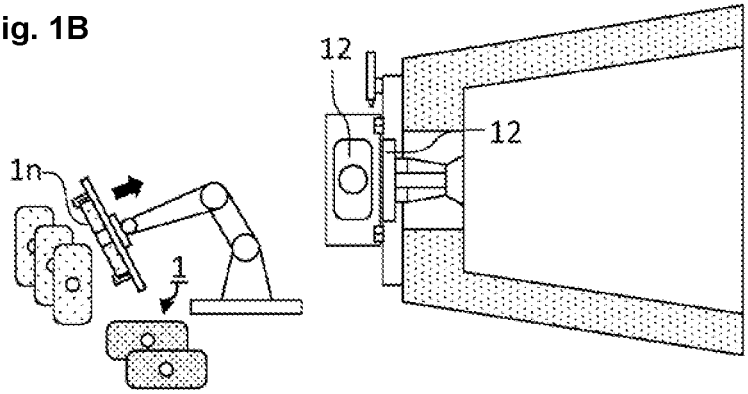
Figure 1D:
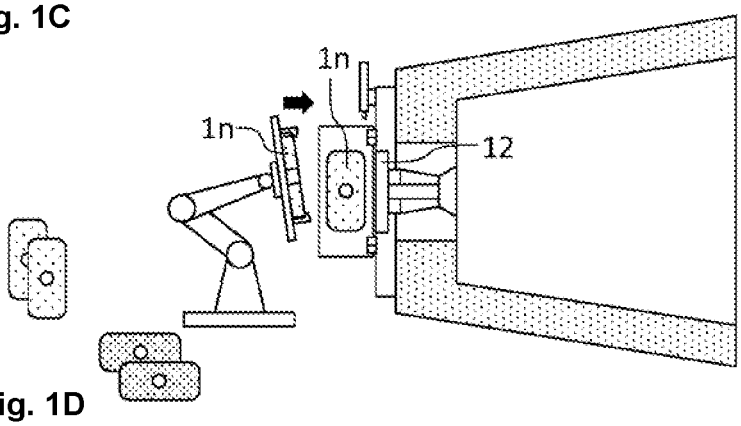

FIGS. 1(*a*) shows a metallurgic vessel (41) such as a tundish or a ladle lying on its side in a workshop where it is checked for worn elements and for refurbishing. The metallurgic vessel comprises a slide gate valve exposed vertically for changing sliding gate valve plates (1*t*, 1L) which are worn and replacing them with new sliding gate valve plates (1*n*) stored in an appropriate place, ready for use. When this operation is generally performed by a human operator, the present invention proposes a solution for the whole operation of removing a spent sliding gate valve plate and replacing it by a new one to be performed by a robot (20). A robotized system according to the present invention for fixing or removing a sliding gate valve plate to or from a sliding gate valve, comprises a sliding gate valve plate (1), a metallurgic vessel (41) provided with a sliding gate valve, and a robot (20). The robot comprises a handling interface (21) for gripping and manipulating the sliding gate valve plate.

As shown in FIG. 1(*a*)&(*b*), when a metallurgic vessel (41) is brought to a workshop, it can be laid on its side to expose the sliding gate valve. The sliding gate valve is opened by the robot by rotation about hinges of the bottom plate support frame (11L) relative to the top plate support frame (11*t*). The robot (20) removes the sliding gate valve plates (1*t*, 1L) from their respective plate support frames (11*t*, 11L) and stores them for repair or for disposal (cf. FIG. 1(*c*)). As shown in FIG. 1(*c*)&(*d*), the robot takes new sliding gate valve plates (1*n*) which were stored for use and couples them to the receiving cradles (12) of the corresponding plate support frames (11*t*, 11L). The bottom plate support frame (11L) can be closed to bring the sliding surfaces (1*s*) of the top and bottom sliding gate valve plates (1*t*, 1L) in sliding contact with one another (cf. FIG. 1(*a*), but with new sliding gate valve plates). The features making all the foregoing operations possible proposed in the present invention are described more in detail in continuation.

Sliding Gate Valve and Sliding Gate Valve Plates

Figure 2A:
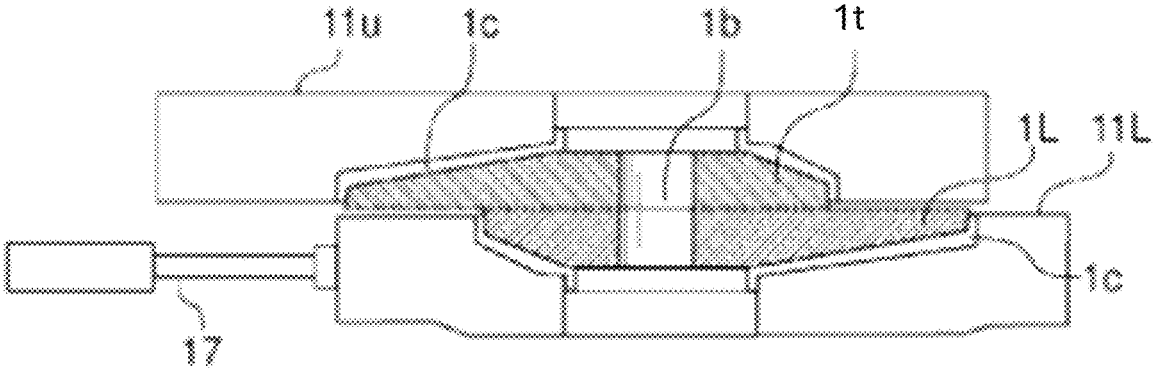
FIG. 2 shows (a) a two-plate and (b) a three-plate sliding gate.
Figure 2B:
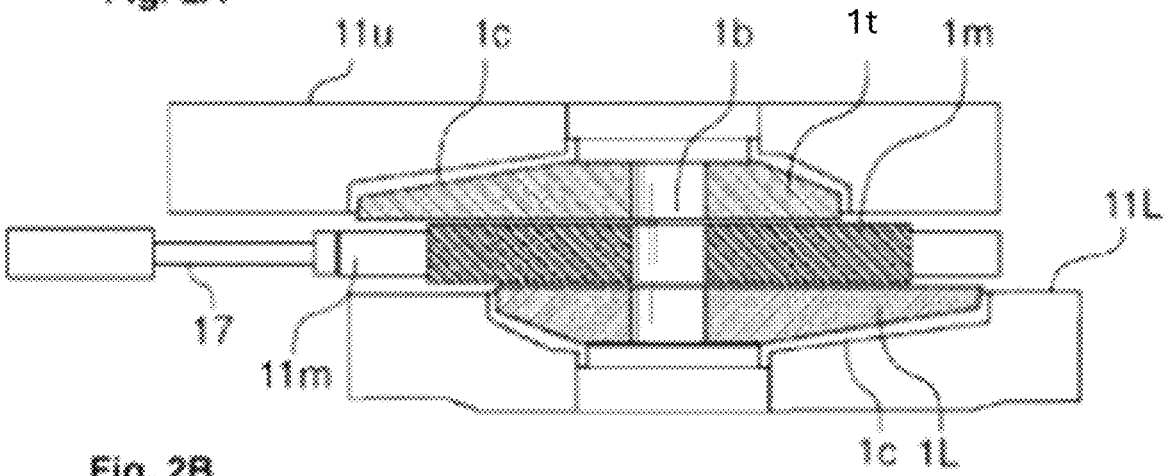

The sliding gate valve can be a two-plate or a three-plate sliding gate valve. As illustrated in FIG. 2(*a*) a two-plate sliding gate valve comprises a top sliding gate valve plate (1*t*) and a bottom sliding gate valve plate (1L), whilst a three-plate sliding gate as illustrated in FIG. 2(*b*) further comprises a mid-sliding gate valve plate (1*m*) sandwiched between a top and a bottom sliding gate valve plate (1*t*, 1L).

A sliding gate valve plate (1) comprises a sliding surface (1*s*) separated from a second surface (1*d*) by a thickness of the sliding gate valve plate and joined to one another by a peripheral edge (1*e*). It also comprises a through bore (1*b*) extending normal to the sliding surface. The second surface (1*d*) of a mid-sliding gate valve plate is also a sliding surface. The top, bottom, and optionally the mid-sliding gate valve plates are each coupled to a receiving cradle (12) of a corresponding top, bottom, and optionally mid-plate support frame (11*t*, 11L, 11*m*), with at least one sliding surface (1*s*) of one plate in sliding contact with a sliding surface (1*s*) of a second plate. The top plate support frame is fixed relative to the metallurgic vessel, because the top sliding gate valve plate (1*t*) is generally coupled to an inner nozzle (42) of the metallurgic vessel (41) with mortar (43) as illustrated in FIG. 7. In a two-plate sliding gate valve (cf. FIG. 2(*a*)) the bottom plate support frame (11L) is a movable carriage which can translate driven by a pneumatic or hydraulic piston (17) such that the sliding surface of the bottom sliding gate valve plate slides in contact against and relative to the sliding surface of the top sliding gate valve plate. In a three-plate sliding gate valve, the bottom plate support frame (11L) is fixed relative to the top plate support frame and to the metallurgic vessel. The mid-plate support frame is a movable carriage suitable for sliding the sliding surface (1*s*) and the second sliding surface (1*d*) (which is also a sliding surface) of the mid-sliding gate valve plate against and relative to the sliding surfaces of the top and bottom sliding gate valve plates, respectively. As well known in the art, the sliding translation of the sliding surface of a sliding gate valve plate relative to the sliding surface of the top sliding gate valve plate and, optionally, of the bottom sliding gate valve plate in a three-plate sliding gate valve, allows the control of the level of overlap between the through bores of the two (or three) plates.

The geometries of the receiving cradles (12) of the plate support frames must mate the geometries of the corresponding sliding gate valve plates, such that one does not move relative to the plate support frame during the sliding of one sliding surface relative to the other driven by the translation of the movable carriage. For access to the sliding gate valve plates, the plate support frame can generally be opened like a book by rotation about hinges of the bottom plate support frame (11L) relative to the top (and/or mid-) plate support frame as illustrated schematically in FIG. 1(*a*)&(*b*)). A sliding gate valve plate (1) freshly laid into a corresponding receiving cradle (12) needs be fixed only to the extent that the plate does not fall off before the bottom plate support frame (11L) is rotated back into its operating position, with the sliding surfaces of the plates in sliding contact with one another. Mechanisms for holding the plates in the receiving cradles during handling are known in the art such as resilient clamps that ensure that a plate does not fall from the plate support frame during handling.

Traditionally, for removing a spent sliding gate valve plate (1) from its receiving cradle (12), in particular a top sliding gate valve plate (1*t*) which is generally fixed with mortar (43) to an inner nozzle (42), an operator would run an elongated tool through the through bore of the sliding gate valve plate and pull and push to remove the sliding gate valve plate from the receiving cradle (12). This operation definitely ruins the through bore of a sliding gate valve plate, which is not so important if it is to be disposed of but does not allow a refurbishing of the plate. Although the elongated tool is not handled as hardly when mounting a new sliding gate valve plate into a receiving cradle (12), there is a risk of damaging the through bore of a new sliding gate valve plate. It is clear that a robot can be configured for handling an elongated tool in a similar way as a human operator would use. To avoid possible damages to the through bore, however, the robotized system of the present invention uses gripping means for safely gripping and handling a sliding gate valve plate. The gripping means permit a sliding gate valve plate to be held by its peripheral edges (1*e*) and/or by its second surface (1*d*) and not at all by the through hole as is traditionally performed by human operators. To this effect, the gripping means require two components: (a) the robot comprises gripping clamps (25*g*, 25*r*, 25*t*) discussed in continuation; (b) the receiving cradle of the plate support frame comprises clearings (15) allowing access of the gripping clamps (25) to gripping holds (5) located at the peripheral edge (1*e*) and/or at the second surface (1*d*), adjacent to the peripheral edge, mating the gripping clamps (25*g*, 25*r*, 25*t*) of the robot, when the sliding gate valve plate is locked in the receiving plate support frame.

In an advantageous embodiment, the gripping means of the robotized system for fixing or removing a sliding gate valve plate to or from a sliding gate valve is configured such that (a) the sliding gate valve plate comprises gripping holds (5) located at the peripheral edge (1*e*) and/or at the second surface (1*d*), adjacent to the peripheral edge, mating the gripping clamps (25*g*, 25*r*, 25*t*) of the robot, such that the robot can securely hold and handle the sliding gate valve plate, (b) the gripping clamps (25*g*, 25*r*, 25*t*) can be moved, preferably by rotation about a rotation axis, from an open position suitable for surrounding the peripheral edge (1*e*) of the sliding gate valve plate to a gripping position suitable for coupling the gripping clamps (25*g*, 25*r*, 25*t*) to the gripping holds (5) of the sliding gate valve plate (1), and (c) the receiving cradle of the plate support frame comprises clearings (15) allowing access of the gripping clamps (25*g*, 25*r*, 25*t*) to the gripping holds (5) when the sliding gate valve plate is locked in the receiving plate support frame.

The Handling Interface (21) of the Robot (20) and Gripping Clamps (25*g*, 25*r*, 25*t*)

The robot used in the present invention can be any robot available on the market comprising sufficient degrees of freedom, such as for example, five to seven degrees of freedom, for performing the operations of collecting a sliding gate valve plate, moving it between a storage position and a sliding gate valve, and for positioning the sliding gate valve plate into a corresponding receiving cradle (12). One essential feature of the present invention is a handling interface (21) provided at the end of an arm of the robot and equipped with gripping clamps (25*g*, 25*r*, 25*t*) for gripping the sliding gate valve plate. The handling interface (21) is configured for, collecting a new unit (1*n*) of the sliding gate valve plate (1) and coupling and locking it to the corresponding plate support frame (11), and/or unlocking and removing a spent unit of the sliding gate valve plate (1) from the corresponding plate support frame (11), and safely transporting a sliding gate valve plate between a storage position and the plate support frame (11).

The foregoing operations can be safely carried out by means of the gripping clamps (25*g*, 25*r*, 25*t*) which interact with the gripping holds (5) of the sliding gate valve plates. In an advantageous embodiment, the handling interface (21) of the robot comprises N=3 or 4 gripping clamps (25*g*, 25*r*, 25*t*), which are L-shaped in that they comprise a first rod or segment comprising a free end and a second rod or segment comprising a coupled end, said first rod being movably mounted so as to move the free end from an open position suitable for surrounding the peripheral edge (1*e*) of the sliding gate valve plate to a gripping position, thus forming a L-shape such as illustrated in FIG. 8, suitable for coupling the free end of the L-shaped gripping clamps (25*g*, 25*r*, 25*t*) to the gripping holds (5) of the sliding gate valve plate (1). In some embodiments, the gripping clamps (25*g*, 25*r*, 25*t*) comprise more than two rods. Gripping clamps can for example comprise three rods or segments such to be finger-shaped or T-shaped, provided they are suitable for coupling to the gripping holds (5) of the slide gate valve plate (1). Alternatively, instead of a first rod with a free end, the gripping clamps can comprise a gripping head coupled to the second rod. The gripping head is then movably mounted so as to move the gripping head from an open position suitable for surrounding the peripheral edge (1*e*) of the sliding gate valve plate to a gripping position suitable for coupling to the gripping holds (5) of the slide gate valve plate (1).

The L-shaped gripping clamps (25*g*, 25*r*, 25*t*) are movable, from an open position, wherein the L-shaped gripping clamps circumscribe the peripheral edge of a sliding gate valve plate to a gripping position wherein the free ends of the L-shaped gripping clamps interact with the gripping holds (5) of the sliding gate valve plate. In the open position, the L-shaped gripping clamps match the clearings (15) of the corresponding clearings, so that the handling interface (21) can be translated along a direction normal to the sliding surface (1*s*) of a sliding gate valve plate driving the free ends of the L-shaped gripping clamps through the clearings (15) beyond the sliding surface of the sliding gate valve plate, in registry with the gripping holds (5) of the sliding gate valve plate. The L-shaped gripping clamps can then be moved to their gripping position, so that the free ends interact with the gripping holds (5) and the sliding gate valve plate is thus safely gripped.

In an advantageous embodiment, the handling interface (21) of the robot further comprises resilient elements (27) suitable for pressing against the sliding surface (1*s*) when the free ends of the L-shaped gripping clamps are in the gripping position. The resilient elements press against the sliding surface (1*s*) of a sliding gate valve plate away from the handling interface (21), whilst the gripping clamps retain the sliding gate valve plate, thus safely locking the plate into position between the resilient means (27) and the gripping clamps (25*g*, 25*r*, 25*t*) of the handling interface (21). The resilient elements can comprise mechanical springs, such as helicoidal springs or blade springs, or can be made of resilient materials, such as rubbers. Because the temperature of a sliding gate valve plate can vary greatly depending on whether it is a new plate, or a spent plate brought directly after a casting operation, it is advantageous that the resilient means comprise mechanical springs. The portion of the resilient elements contacting the sliding surface (1*s*) of a sliding gate valve plate must be such as to avoid damaging the sliding surface by scratching. In an alternative embodiment, as illustrated in FIG. 9, the handling interface (21) of the robot further comprises rigid elements (28) for pressing against the sliding surface (1*s*) when the free ends of the L-shaped gripping clamps are in the gripping position.

The movable L-shaped gripping clamps (25*g*, 25*r*, 25*t*) are preferably rotatably mounted so as to rotate between the open and gripping positions about a rotation axis. Rocking clamps (25*r*) rotate about a rotation axis intersecting the coupled end, and normal to both rods of the L-shaped gripping clamps including the free end and the coupled end (cf. FIGS. 4, 5, and 7). Rocking clamps are advantageous because they allow the application of a pulling force to a sliding gate valve plate laid in a receiving cradle (12) when rocking from the open position to the gripping position.

Figure 4A:
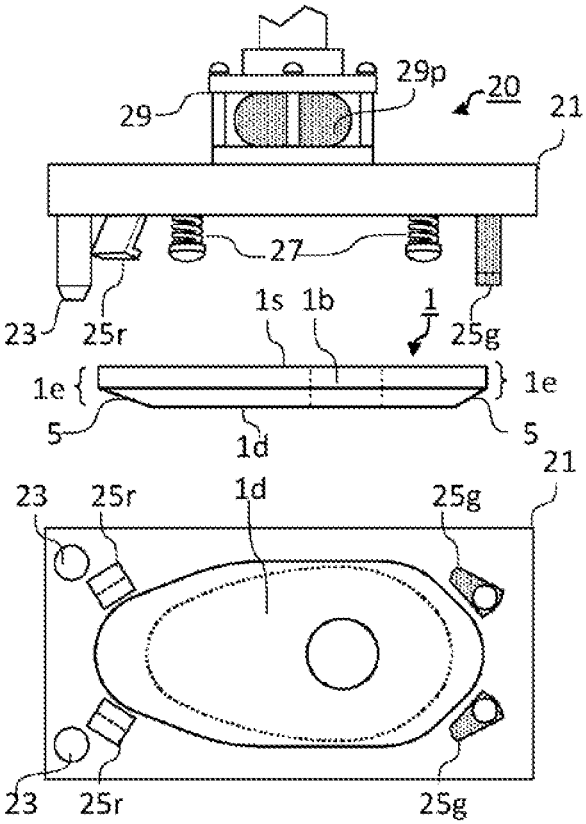
FIG. 4 shows a side view and top view of a sliding gate valve plate and of a handling interface of a robot (a) before coupling and (b) after coupling.
Figure 4B:
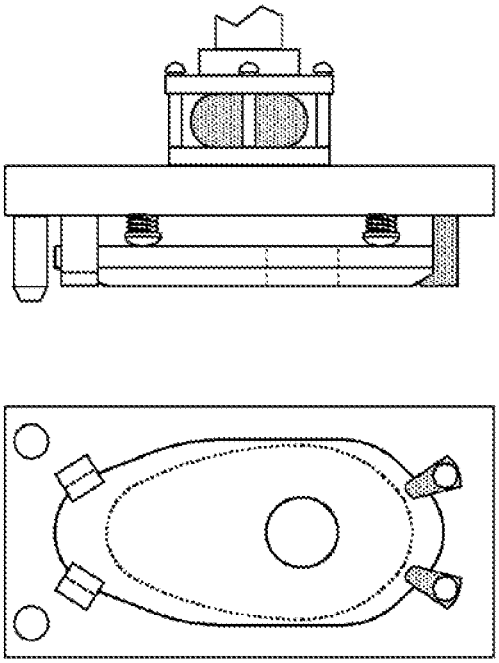
Figure 5A:
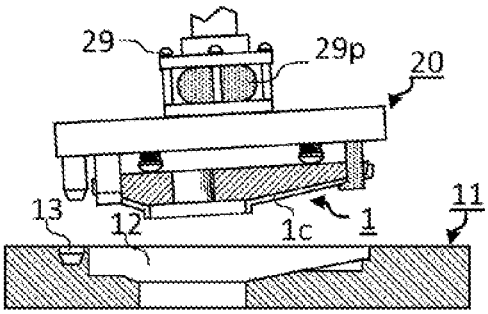
FIG. 5 shows various steps according to a first implementation for coupling a sliding gate valve plate to a plate support frame using a pneumatic or hydraulic coupling element.
Figure 5B:
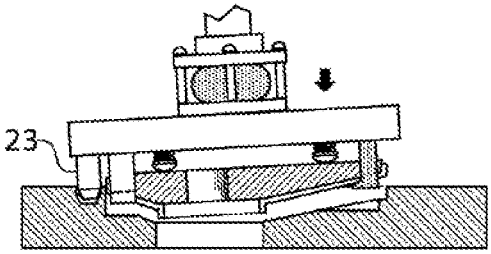
Figure 5C:
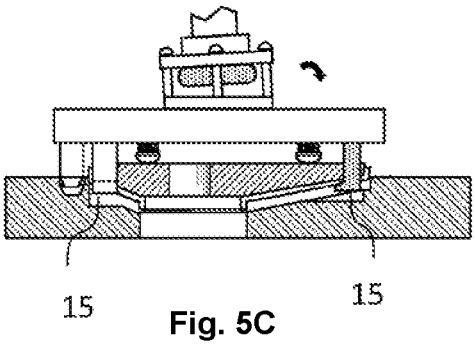
Figure 5D:
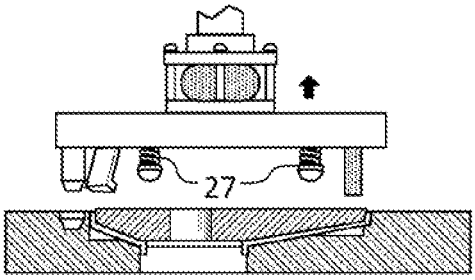

Gyrating clamps (25*g*) rotate about a rotation axis parallel to, preferably coaxial with the rod of the L comprising the coupled end (cf. FIGS. 4, 5, and 7). Gyrating clamps (25*g*) are advantageous because they require only a small clearing in the receiving cradle to reach and engage the gripping holds (5) of the sliding gate valve plate.

In an alternative embodiment, as illustrated in FIG. 9, the gripping clamps (25*t*) are mounted so as to translate between the open and gripping positions relative to the handling interface (21). The translation advantageously comprises at least one component in a plane parallel to the sliding surface (1*s*).

FIG. 9 (*a*)-(*d*) illustrates a method for fixing a new sliding gate valve plate (1*n*) to a top plate support frame (11*t*) of a slide gate valve comprising, (a) providing a robotized system as discussed supra, (b) driving the handling interface (21) toward a new unit (1*n*) of a top slide gate valve plate (1*t*), (c) engaging the gripping clamps (25*t*) by translation in the gripping holds (5) of the new unit (1*n*) thus reaching their gripping position, such that the robot securely holds and can handle the new unit (1*n*), (d) driving the handling interface (21) with the new unit (1*n*) to the plate support frame (11*t*), with the gripping clamps (25*t*) engaged in the corresponding clearings (15), (e) disengaging the gripping clamps (25*t*) by translation from the gripping holds (5), (f) driving the handling interface (21) away from the top plate support frame (11*t*).

Before driving the new unit (1*n*) to the top plate support frame (11*t*), the second surface (1*d*) of the top slide gate valve plate (1*t*) is advantageously coated with mortar, such that it will adhere to the inner nozzle (42). Alternatively, the inner nozzle (42) can be coated with mortar before the new unit (1*n*) is driven to the plate support frame (11*t*), such that it will adhere to the top slide gate valve plate (1*t*).

When the rotating clamps are rotatably mounted, the handling interface (21) can comprise rocking clamps (25*r*) only (i.e., N rocking clamps), gyrating clamps only (25*g*) (i.e., N gyrating clamps), or both rocking and gyrating clamps (25*r*, 25*g*) (i.e., n rocking clamps and N−n gyrating clamps, with n<N). In an advantageous embodiment, illustrated in FIG. 4, the handling interface (21) comprises N=4 gripping clamps, of which n=2 are rocking clamps (25*r*) and N−n=2 are gyrating clamps (25*g*). In an alternative embodiment, N=3 gripping clamps, of which n=1 are rocking clamps (25*r*) and N−n=2 are gyrating clamps (25*g*).

A sliding gate valve plate (1) can be inscribed in a rectangle defining a length, L, and width, W, with W≤L of the sliding gate valve plate. It is advantageous that a pair of similar gripping clamps be located side by side adjacent to a first end of the length, L, and one or a pair of similar gripping clamps be located side by side adjacent to a second end, opposite the first end of the length, L, wherein the pair of gripping clamps adjacent to the first end can be same as or different from the one or pair of gripping clamps adjacent to the second end. For example, the handling interface (21) of the robot can comprise one or two adjacent rocking clamps (25*r*) at a first end of the length, L, and comprises one or two adjacent gyrating clamps (25*g*) at a second end of the length, L.

FIG. 8(*a*) shows an advantageous embodiment of handling interface (21) comprising resilient element (27) and a pair of gyrating grips (25*g*) and a pair of rocking clamps (25*r*). As illustrated in FIG. 8(*b*), the rocking clamps can rock over two axes of rotation, x1 and x2. FIG. 8(*c*)&(*d*) show single-axis rocking clamps (25*r*) comprising a single axis of rotation x1 or x2. FIG. 8(*e*) shows a dual-axes rocking clamp (25*r*) with two axes of rotation x1 and x2, enlarging the moving span of the rocking clamps.

A combination of rocking and gyrating gripping means can be particularly advantageous for ripping a spent top sliding gate valve plate (1*t*) coupled to an inner nozzle (42) by means of a mortar (43) as illustrated in the embodiment of FIG. 7. In this embodiment, the handling interface (21) or the top plate support frame (11) comprises a protrusion (19) such that when the robot faces the top plate support frame to remove the top sliding gate valve plate therefrom, one or two gyrating clamps (25*g*) have penetrated through the corresponding clearings (15) and are rotated to their gripping position, whilst the protrusion (19) allows only partial penetration of the rocking clamps (25*r*) through the corresponding clearing, such that the handling interface (21) is at an angle with respect to the sliding surface (1*s*) of the top sliding gate valve plate (1*t*). The one or two rocking clamps are still in their open position (cf. FIG. 7(*a*)&(*b*)). In this position, the rocking clamps (25*r*) are rotated to their gripping position. As shown in FIG. 7(*c*), the rocking movement of the L-shaped rocking clamps pulls the corresponding end of the top sliding gate valve plate creating a rotational moment on the plate about an axis passing by the one or two gyrating clamps allowing disruption of the mortar (43) adhering the top sliding gate valve plate to the inner nozzle (42) by progression of a crack between mortar (43) and second surface (1*d*) along the length of the top sliding gate valve plate. This solution obviously requires less energy and force than pulling the top sliding gate valve plate away from the inner nozzle along a direction normal to the sliding surface (1*s*), which would require the whole area of the interface between mortar and top sliding gate valve plate to be disrupted simultaneously. The protrusion (19) is preferably retractable, so that it is used only for removing a spent sliding gate valve plate from the support frame (preferably top sliding gate valve plates (1*t*)), and it can be retracted so as to not interfere with the positioning of a new sliding gate valve plate onto a receiving cradle.

This embodiment can thus be used in a method illustrated in FIG. 7 for removing a top sliding gate valve plate (1*t*) from a plate support structure (11) of a slide gate valve mounted at a bottom of a metallurgic vessel, comprising, (a) providing a robotized system as discussed supra with a top sliding gate valve plate loaded in a top plate support frame (11*t*) and coupled to an inner nozzle (42) with mortar (43), (b) engaging the gyrating clamps (25*g*) entirely into the corresponding clearings (15) and rotating the gyrating clamps to engage into the corresponding gripping holds (5) thus reaching their gripping position, (c) engaging the rocking clamps (25*r*) into the corresponding clearings (15) as far as the protrusion (19) allows, and rotating the rocking clamps towards their gripping position to partially engage the rocking clamps into the corresponding gripping holds, thereby pulling one end of the top sliding gate valve plate away from the inner nozzle, and initiating a crack in the mortar until the rocking clamps are entirely engaged into the corresponding gripping holds, and reach their gripping position, (d) removing the top sliding gate valve plate from the top plate support frame by driving the handling interface away from the top plate support frame.

The gyrating clamps (25*g*) can be rotated prior to or simultaneously with the rocking clamps (25*r*). A simultaneous rotation of the gyrating and rocking clamps allows using a single drive for driving the rotation of the two types of clamps.

One major advantage of rotatable L-shaped gripping clamps as discussed supra is that they can adapt to sliding gate valve plates of slightly varying geometries, either because the plates have a different design, or because they are at different temperatures: room temperature for a new sliding gate valve plate (1*n*), and substantially higher temperatures for spent sliding gate valve plates, which are thermally expanded relative to the new ones at room temperature.

Robot (20)

Because each new metallurgic vessel (41) is not necessarily positioned at exactly the same position relative to the robot (20), It is not practical to configure the robot to repeat exactly the same movements with each new metallurgic vessel. It is therefore advantageous that the robot be provided with an electromagnetic wave recognition system, such as an optical camera system with recognition of elements, infrared (e.g., Lidar), radar, etc. These systems may not have the accuracy required for the operations to be performed by the robot and, in case of an optical recognition system, fumes and vapours may disrupt visibility and the accuracy of the movements.

In one embodiment, illustrated in FIGS. 4&5, the handling interface (21) may comprise guiding pins (23) protruding beyond a plane comprising the sliding surface (1*s*) when a sliding gate valve plate (1) is gripped. The plate support frame (11) comprises funnel shaped cavities (13) for receiving the guiding pins and guiding the sliding gate valve plate in alignment with the receiving cradle (12). In FIGS. 4&5, two guiding pins are illustrated. It is clear that the handling interface can comprise two, three, or four such pins, preferably two or three. As shown in FIG. 5, if the guiding pins allow a re-alignment of the handling interface (21) holding a sliding gate valve plate relative to the plate support frame, this is only made possible if the "wrist" between the arm of the robot (20) and the handling interface (21) is flexible.

It is therefore advantageous as illustrated in FIGS. 1,5&7, to provide the robot with a coupling element (29) coupling the arm of the robot to the handling interface (21). The coupling element (29) comprises pneumatic or hydraulic system (29*p*) capable of controlling the compliance of the coupling element and thus the compliance or flexibility of the coupling of the handling interface (21) to the robot. Examples of coupling elements (29) are described e.g., in US2017045106 and in EP2500150. When the pneumatic or hydraulic system (29*p*) is under pressure, the coupling element is rigid. A rigid coupling element (29) is used during transportation of a sliding gate valve plate (1) from one point to another, as shown in FIGS. 5(*a*), 5(*b*), and 5(*d*), and 7(*a*) and 7(*d*).

When small movements of the handling interface (21) relative to the arm of the robot it is attached to are required, the pressure in the pneumatic or hydraulic system (29*p*) is released, the coupling element becomes compliant allowing the handling interface (21) to rotate and translate relative to the robot arm. A compliant coupling element (29) is useful when the position of the handling interface (21) relative to the support frame must be finetuned beyond the accuracy of the robot's arm (note that the plates are quite heavy, which is detrimental to the accuracy of the robot's arm). For example, as shown in FIGS. 5(*b*)&(*c*) as the guiding pins (23) contact the corresponding funnel shaped cavities (13), the handling interface (21) needs to realign relative to the plate support frame as the guiding pins (23) penetrate deeper into the funnel-shaped cavities (13). At this stage it is important to keep the coupling element (29) as compliant as possible to allow the handling interface to re-align as it moves further towards the plate support frame. Similarly, in FIG. 7(*b*)&(*d*), the protrusion (19) forces the handling interface to tilt at an angle relative to the plate support frame (11). Here again, the coupling element (29) must be flexible by reducing the pressure in the pneumatic or hydraulic system (29*p*).

The robot can be mounted on a rotating basis and, to increase the span if its reach, can be mounted on rails to move between a storing position and a slide gate valve position.

Gripping Holds (5) of the Sliding Gate Valve Plates

In one embodiment illustrated in FIGS. 2 to 5, and 6(*a*)(*iv*), the sliding gate valve plate is a top or a bottom sliding gate valve plate, wherein the second surface (1*d*) has an area smaller than the sliding surface (1*s*) and, in a projection onto the sliding surface, the second surface is enclosed within the sliding surface, and wherein the peripheral edge (1*e*) and/or the second surface comprises bevelled portions forming the gripping holds (5). A sliding gate valve plate of this type is described for example in WO2017129563. Besides the advantages described in this document afforded by such geometry of the sliding gate valve plate, the bevelled portions of the peripheral edge (1*e*) (or of the second surface (1*d*)) can be taken advantage of as forming the gripping holds (5) for interacting with the gripping clamps (25*g*, 25*t*) of the handling interface (21). The bevelled portions of the sliding gate valve plate give access and a hold to the free ends of the L-shaped gripping clamps (25*g*, 25*r*, 25*t*).

Figure 6A:
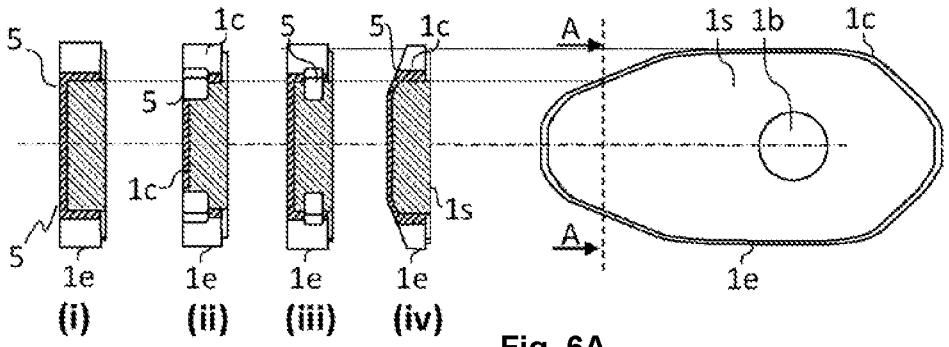
FIG. 6 shows top views and cross-sectional views of a sliding gate valve plate comprising gripping holds (a) in the form of portions of the second surface (i) or recesses (ii-iv) and (b) in the form of protrusions.
Figure 6B:
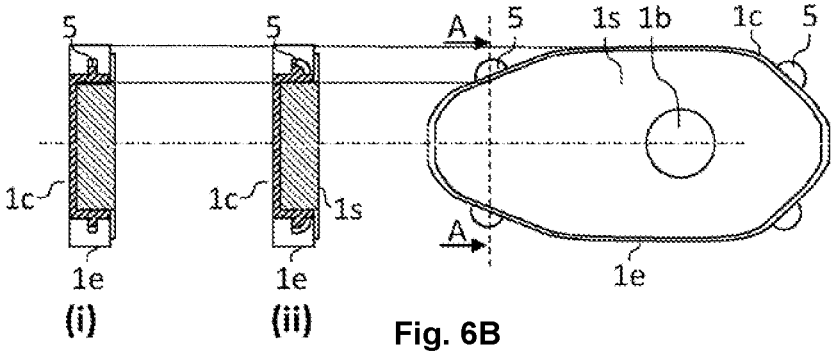
Figure 7D:
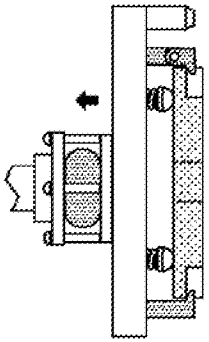
FIG. 7 shows various steps for ripping the mortar coupling a top slide gate valve plate to an inner nozzle of a metallurgic vessel, as the top sliding gate valve plate is being removed from its receiving cradle.
Figure 7C:
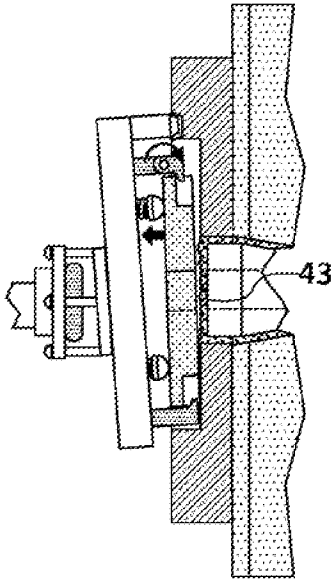
Figure 7B:
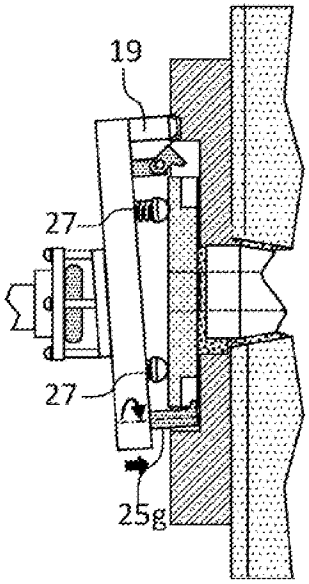
Figure 7A:
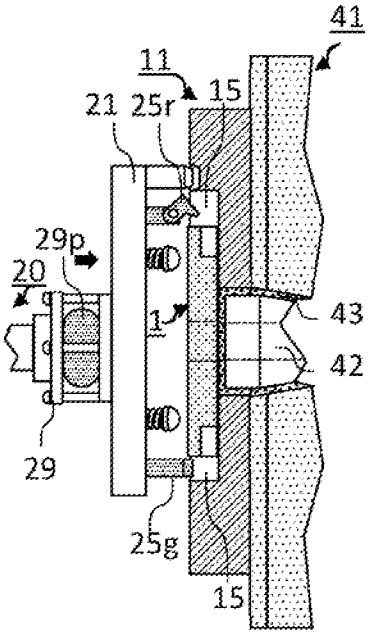
Figure 8A:
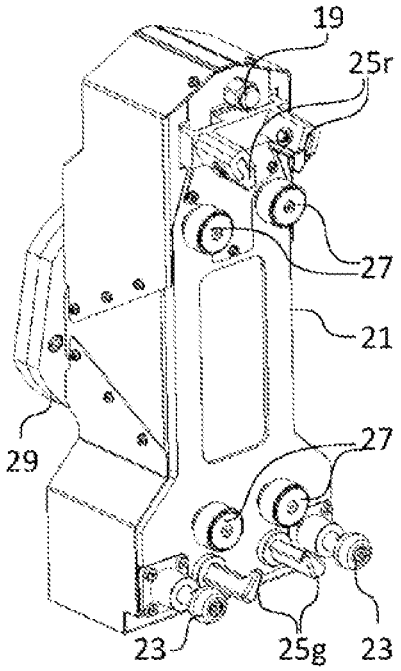
FIG. 8 shows an embodiment of handling interface according to the present invention (a) general perspective view, (b) detail on dual axes-rocking clamps, and (c)-(e) show single and dual axes rocking clamps.
Figure 8B:
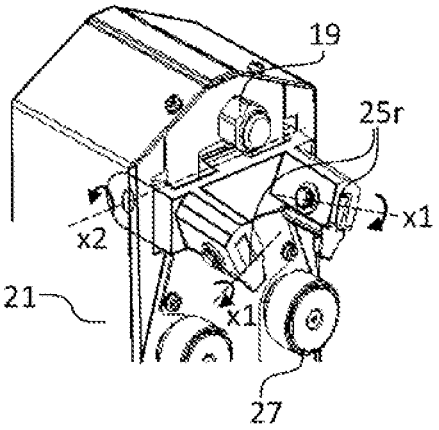
Figure 8C:
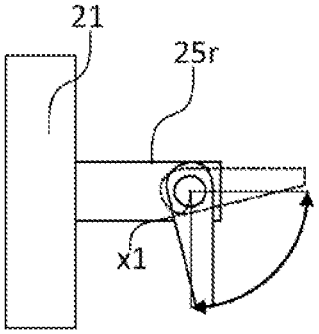
Figure 8D:
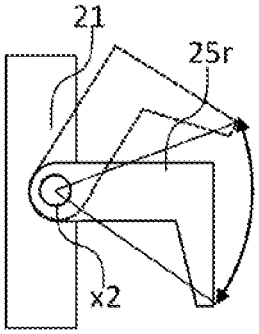
Figure 8E:
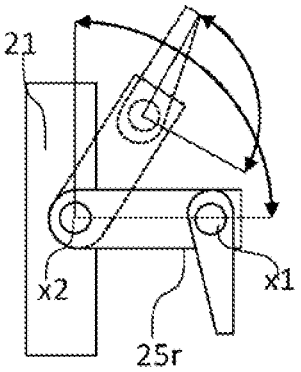
Figure 9D:
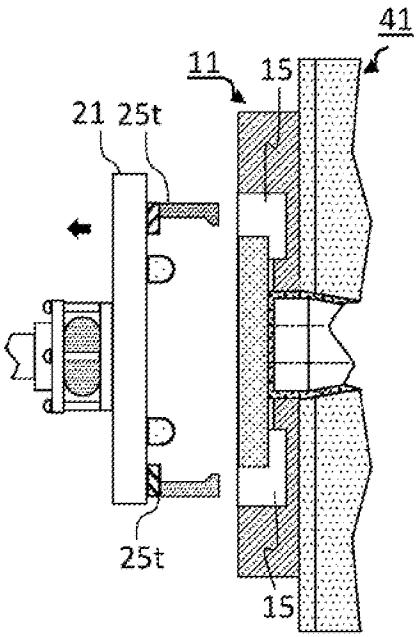
FIG. 9 shows various steps according to a second implementation for coupling a slide gate valve plate to a plate support frame using a pneumatic or hydraulic coupling element.
Figure 9C:
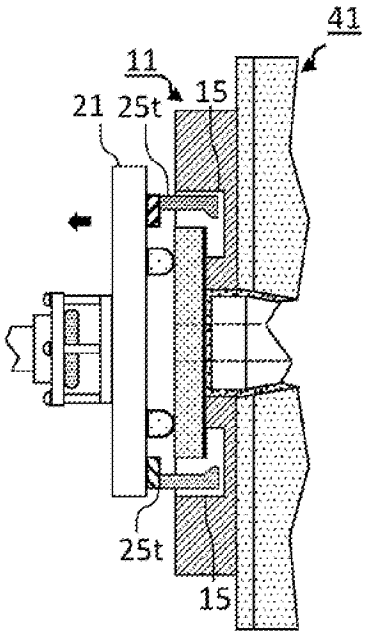
Figure 9B:
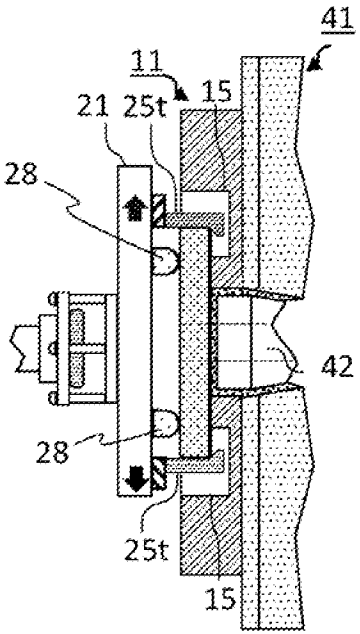
Figure 9A:
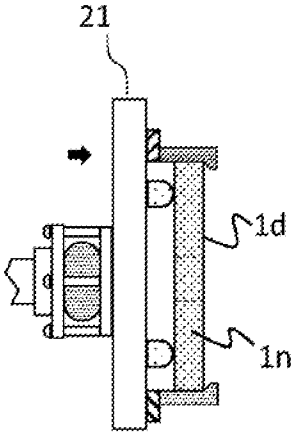

In an alternative embodiment, illustrated in FIG. 6(*a*)(*i*), the second surface (1*d*) has substantially the same area as the sliding surface (1*s*). The gripping holds (5) can then be portions of the second surface (1*d*) of the plate (1) adjacent to the peripheral edge (1*e*). Such portions need to be sufficiently large to receive the gripping clamps (25*g*, 25*r*, 25*t*) in the gripping position, such that the robot can securely hold and handle the sliding gate valve plate (1).

In an alternative embodiment, illustrated in FIG. 6(*a*)(*ii*)&(*iii*), the gripping holds (5) are recesses opening at the peripheral edge (1*e*) and penetrating in the thickness of the slide gate valve plate. If a portion of the sliding gate valve plate (1) is cladded with a metal can (1*c*), the recesses are at least partly formed in the metal can. The recess can open exclusively at the peripheral edge (1*e*) as illustrated in FIG. 6(*a*)(*iii*). This embodiment is particularly suited for mid-sliding gate valve plates (1*m*) which comprise two opposite sliding surfaces (1*s*) and should preferably not comprise an opening. Alternatively, the recess can open both at the peripheral edge (1*e*) and second surface (1*d*) as illustrated in FIG. 6(*a*)(*ii*). This embodiment makes it easier for the gripping clamps (25*g*, 25*g*) to engage the gripping holds (5) by simply driving the gripping clamps in open position all the way to the bottom floor of the receiving cradle, and thence move the gripping means into the gripping position, preferably by rotation, to engage into the recesses which are located at the level of the bottom floor.

In yet an alternative embodiment illustrated in FIG. 6(*b*), the gripping holds (5) can be protrusions protruding out of the peripheral edge (1*e*) and are preferably part of a metal can (1*c*) cladding a portion of the peripheral edge. Two examples of such protruding gripping holds (5) are illustrated in FIG. 6(*b*)(*i*)&(*ii*).

Clearings or Apertures (15) of the Plate Support Frame (11)

Figure 3A:
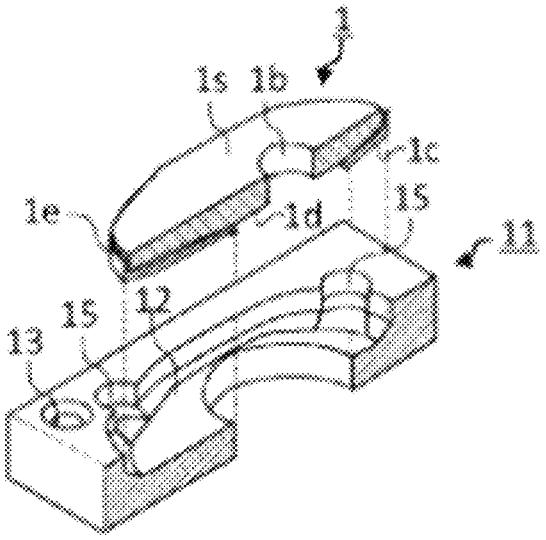
FIG. 3 shows perspective cross-cut view of a sliding gate valve plate and of a plate support frame (a) before coupling and (b) after coupling.
Figure 3B:
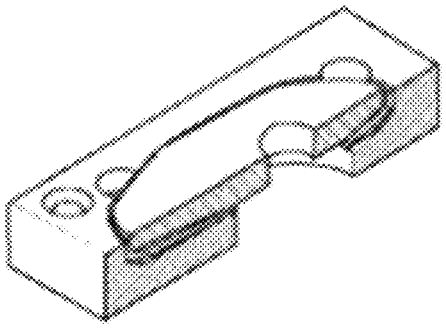

As illustrated in FIG. 3, the receiving cradle (12) can be nearly an imprint of the second surface (1*d*) of the sliding gate valve plate (1). In such configuration, the clearings (15) must be open at the periphery of the receiving cradle, at locations corresponding to the locations of the gripping clamps (25*g*, 25*r*, 25*t*) of the handling interface, and must be dimensioned such as to allow the passage of the gripping clamps in an open position along a direction normal to the sliding surface (1*s*) when a plate is held in the receiving cradle (12). The clearings (15) must also be sufficiently deep to allow the gripping clamps to reach a position facing the gripping holds so that by rotation (or other movement) they can move to the gripping position, engaging the gripping holds. The size and geometry of the clearings must be a compromise between, on the one hand, ease of access of the gripping clamps to the gripping holds and, on the other hand, the stability of the position of the sliding gate valve plate conferred by the receiving cradle upon sliding the sliding surface of one plate against the sliding surface of another plate.

When the gripping holds (5) are portions of the second surface (1*d*) of the plate (1) adjacent to the peripheral edge (1*e*), such as represented in FIG. 6(*a*)(*i*), it is necessary that the clearings (15) are sufficiently deep to allow the gripping clamps (5*g*, 5*r*, 5*t*) to reach a position facing the second surface (1*d*) of the plate when the sliding gate valve plate is locked in the receiving plate support frame (11), so that they can move to the gripping position, engaging the second surface (1*d*).

The receiving cradle can also comprise a bottom floor and holding blocks protruding out of the bottom floor and positioned at strategic locations for holding a sliding gate valve plate in place upon actuating the sliding gate valve. With such configurations, clearings (15) are readily available and the plate support frame (11) needs not be amended to implement the robotized system of the present invention. Only the sliding gate valve plates need be provided with gripping holds (5). In the case of sliding gate valve plates comprising a bevelled peripheral edge as described in WO2017129563, even the plates need not be amended, and only the robot and the handling interface are required for implementing the present invention. This is a great advantage as only minimal adaptions are required.

Various features and characteristics of the invention are described in this specification and illustrated in the drawings to provide an overall understanding of the invention. It is understood that the various features and characteristics described in this specification and illustrated in the drawings can be combined in any operable manner regardless of whether such features and characteristics are expressly described or illustrated in combination in this specification. The Inventor and the Applicant expressly intend such combinations of features and characteristics to be included within the scope of this specification, and further intend the claiming of such combinations of features and characteristics to not add new matter to the application. As such, the claims can be amended to recite, in any combination, any features and characteristics expressly or inherently described in, or otherwise expressly or inherently supported by, this specification. Furthermore, the Applicant reserves the right to amend the claims to affirmatively disclaim features and characteristics that may be present in the prior art, even if those features and characteristics are not expressly described in this specification.

Therefore, any such amendments will not add new matter to the specification or claims, and will comply with the written description requirement under 35 U.S.C. § 112(a). The invention described in this specification can comprise, consist of, or consist essentially of the various features and characteristics described in this specification.

Advantages

The present invention is advantageous as it relieves human operators from hard labour conditions and is more reproducible with less to no risk of human error. Only minimal amendments are required in the installation to implement the invention. The clearing (15) in the receiving cradle (12) required for allowing the passage of the gripping clamps can be quite small, especially when using gyrating or rocking clamps (25*g*, 25*r*, 25*t*). The gripping clamps of the handling interface are quite insensitive to dimensional variations due to variations in temperature of a sliding gate valve plate. The sliding gate valve plates only need minimal redesigning, if at all, in case bevelled plates as described in WO2017129563 are used. The use of a coupling element (29) comprising pneumatic or hydraulic system (29*p*) gives the robot the compliance necessary for removing and loading into a receiving cradle relatively heavy sliding gate valve plates with high accuracy, thus reducing the risks of breaking any part.

LIST OF REFERENCES

1: sliding gate valve plate
1*b*: through bore
1*c*: metal can
1*d*: second surface of the plate
1*e*: peripheral edge
1*n*: new unit
1*t*: top sliding gate valve plate
1L: bottom sliding gate valve plate
1*m*: mid-sliding gate valve plate
1*s*: sliding surface of plate
5: gripping holds
11: plate support frame
11L: bottom plate support frame
11*m*: mid-plate support frame
11*t*: top plate support frame
12: receiving cradle
13: funnel shaped cavities
15: clearing
17: piston
19: protrusion
20: robot
21: handling interface
23: guiding pins
25*r*: rocking clamp
25*g*: gyrating clamp
27: resilient element
29: coupling element; 29*p*: pneumatic or hydraulic system
41: metallurgic vessel
42: inner nozzle
43: mortar

What is claimed is:

1. A robotized system for fixing or removing a sliding gate valve plate to or from a sliding gate valve, comprising:

(a) a sliding gate valve plate comprising a sliding surface separated from a second surface by a thickness of the sliding gate valve plate and joined to one another by a peripheral edge, and comprising a through bore extending normal to the sliding surface, wherein the sliding gate valve plate is selected from the group consisting of:

a top sliding gate valve plate, a bottom sliding gate valve plate, and a mid-sliding gate valve plate wherein the second surface is a second sliding surface, (b) a metallurgic vessel provided with a sliding gate valve comprising a support structure comprising a plate support frame comprising a receiving cradle configured for receiving and locking the sliding gate valve plate, including, a fixed top plate support frame configured for receiving and locking the top sliding gate valve plate, a bottom plate support frame configured for receiving and locking the bottom sliding gate valve plate, and a mid-plate support frame configured for receiving and locking the mid-sliding gate valve plate, sandwiched between the top and bottom sliding gate valve plates, wherein the bottom plate support frame is a movable carriage configured for sliding the sliding surface of the bottom sliding gate valve plate against and relative to the sliding surface of the top sliding gate valve plate, thus forming a two-plate sliding gate, or the mid-plate support frame is a movable carriage configured for sliding the sliding surface and the second sliding surface of the mid-sliding gate valve plate against and relative to the sliding surfaces of the top and bottom sliding gate valve plates, respectively, thus forming a three-plate sliding gate, for bringing into and out of registry the through bores of the top and bottom sliding gate valve plates, or the through bores of the top, mid, and bottom sliding gate valve plates, (c) a robot comprising a handling interface provided with gripping clamps-configured for gripping the sliding gate valve plate, and configured for performing at least one of the functions of, collecting a new unit of the sliding gate valve plate and coupling and locking it to the corresponding plate support frame, and unlocking and removing a spent unit of the sliding gate valve plate from the corresponding plate support frame, wherein, (d) the gripping clamps movably mounted to the handling interface and configured to be moved from an open position in which free ends of the gripping clamps surround the peripheral edge of the sliding gate valve plate to a gripping position in which the free ends of the gripping clamps couple to gripping holds located at the peripheral edge and/or at the second surface, adjacent to the peripheral edge, of the sliding gate valve plate, configured so that the robot can securely hold and handle the sliding gate valve plate, and wherein (e) the receiving cradle of the plate support frame comprises clearings accommodating access of the gripping clamps to the gripping holds when the sliding gate valve plate is locked in the receiving cradle of the plate support frame.

2. The robotized system according to claim 1, wherein the sliding gate valve plate is one of a top sliding gate valve plate or a bottom sliding gate valve plate; wherein the second surface-has an area smaller than the sliding surface and, in a projection onto the sliding surface, the second surface is enclosed within the sliding surface; and wherein at least one of the peripheral edge and the second surface comprises bevelled portions forming the gripping holds.

3. The robotized system according to claim 1, wherein the gripping holds comprise protrusions protruding out of the peripheral edge.

4. The robotized system according to claim 1, wherein the gripping holds comprise recesses opening at the peripheral edge and penetrating in the thickness of the slide gate plate.

5. The robotized system according to claim 1, wherein the gripping holds comprise portions of the second surface adjacent to the peripheral edge, and the clearings are then sufficiently deep to allow the gripping clamps to reach a position facing said portions of the second surface when the sliding gate valve plate is locked in the receiving plate support frame, so that the gripping clamps can move to the gripping position, engaging the second surface.

6. The robotized system according to claim 1, wherein the handling interface of the robot comprises N gripping clamps, wherein N is selected from the group consisting of 3 and 4, which gripping clamps are L-shaped.

7. The robotized system according to claim 6, wherein the L-shaped gripping clamps are rotatably mounted so as to rotate between the open and gripping positions about a rotation axis, wherein a disposition of the rotation axis is one of:

intersecting the coupled end normal to both free end and coupled end, forming a rocking clamp, or coaxial with the coupled end forming a gyrating clamp.

8. The robotized system according to claim 7, wherein the handling interface of the robot comprises one or two adjacent rocking clamps, and comprises one or two adjacent gyrating clamps, and the handling interface or the top plate support frame comprises a protrusion configured so that when the robot faces the top plate support frame to remove the top sliding gate valve plate therefrom, with the one or two gyrating clamps in gripping position, the robot is at an angle with respect to the sliding surface such that the one or two rocking clamps can rotate and contact the gripping holds, but are not configured to reach the gripping position without pulling one end of the top sliding gate valve plate which rotates about an axis passing by the one or two gyrating clamps and easily breaking mortar adhering it to the metallurgic vessel.

9. The robotized system according to claim 6 wherein the handling interface of the robot further comprises resilient elements configured for pressing against the sliding surface when the free ends of the L-shaped gripping clamps are in the gripping position and thus locking the sliding gate valve plate to the handling interface of the robot.

10. The robotized system according to claim 1, wherein the handling interface of the robot comprises guiding pins protruding beyond a plane comprising the sliding surface when a sliding gate valve plate is gripped, and the plate support frame comprises funnel shaped cavities for receiving the guiding pins and guiding the sliding gate valve plate in alignment with the receiving cradle.

11. The robotized system according to claim 1, wherein the handling interface is coupled to an arm of the robot by a coupling element comprising a system selected from the group consisting of a pneumatic system and a hydraulic system capable of controlling the compliance of the coupling element and thus the compliance of the coupling of the handling interface to the robot.

12. A method for fixing a sliding gate valve plate to or from a sliding gate valve comprising, providing a robotized system according to claim 1, driving the handling interface towards a new unit of a slide gate valve plate, engaging the gripping clamps in the gripping holds of the new unit thus reaching their gripping position, such that the robot securely holds and handles the new unit, driving the handling interface with the new unit-to the plate support frame, with the gripping clamps engaged in the corresponding clearings, disengaging the gripping clamps from the gripping holds, driving the handling interface away from the plate support frame.

13. A method for removing a top sliding gate valve plate from a plate support structure of a slide gate valve mounted at a bottom of a metallurgic vessel, comprising, providing a robotized system according to claim 8, with a top sliding gate valve plate loaded in a top plate support frame and coupled to an inner nozzle with mortar, engaging the gyrating clamps entirely into the corresponding clearings and rotating the gyrating clamps to engage into the corresponding gripping holds thus reaching their gripping position, engaging the rocking clamps into the corresponding clearings as far as the protrusion allows, and rotating the rocking clamps towards their gripping position to partially engage the rocking clamps into the corresponding gripping holds, thereby pulling one end of the top sliding gate valve plate away from the inner nozzle, and initiating a crack in the mortar until the rocking clamps are entirely engaged into the corresponding gripping holds, and reach their gripping position, and removing the top sliding gate valve plate from the top plate support frame by driving the handling interface away from the top plate support frame.

* * * * *